US006247774B1

(12) United States Patent
Mueller

(10) Patent No.: US 6,247,774 B1
(45) Date of Patent: Jun. 19, 2001

(54) POSTAGE METER MACHINE

(75) Inventor: Ralf Mueller, Berlin (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/146,342

(22) Filed: Sep. 2, 1998

(30) Foreign Application Priority Data

Sep. 5, 1997 (DE) ..... 297 16 523 U

(51) Int. Cl.[7] ..... B41J 3/00

(52) U.S. Cl. ..... 347/2; 347/4; 347/104; 346/24; 400/596; 400/708; 101/91

(58) Field of Search ..... 347/2, 4, 104; 400/708, 596; 346/24; 101/91

(56) References Cited

U.S. PATENT DOCUMENTS

| | | | | |
|---|---|---|---|---|
| 4,478,508 | * | 10/1984 | Kato et al. | 399/384 |
| 4,686,540 | * | 8/1987 | Leslie et al. | 346/33 R |
| 4,707,704 | * | 11/1987 | Allen et al. | 346/24 |
| 4,746,234 | | 5/1988 | Harry | 400/120.01 |
| 5,495,103 | | 2/1996 | Utiger et al. | 250/222.1 |
| 5,524,995 | * | 6/1996 | Brookner et al. | 400/596 |
| 5,639,171 | * | 6/1997 | Brewster, Jr. et al. | 400/708 |
| 5,879,092 | * | 3/1999 | Brannan | 400/708 |
| 5,880,747 | * | 3/1999 | Bartenwerfer et al. | 347/4 |
| 5,940,106 | * | 8/1999 | Walker | 347/104 |
| 5,956,051 | * | 9/1999 | Davies et al. | 347/2 |
| 6,041,704 | * | 3/2000 | Pauschinger | 101/91 |

FOREIGN PATENT DOCUMENTS

| | | |
|---|---|---|
| 196 05 014 | 3/1997 | (DE) . |
| 0 189 268 | 12/1989 | (EP) . |

* cited by examiner

*Primary Examiner*—John Barlow
*Assistant Examiner*—An H. Do
(74) *Attorney, Agent, or Firm*—Schiff Hardin & Waite

(57) ABSTRACT

A postage meter machine has a digital printer device with a guide plate and a transport mechanism for print media controlled by a control unit that generates print control signals for a printhead in order to print the print medium surface with a corresponding print format while the print medium is being transported past the printhead. A print sensor is arranged in the guide plate before a recess for the printhead. A preparation sensor is arranged in the guide plate at a predetermined distance upstream, preceding the print sensor. The control unit includes a microprocessor to which an encoder for determining the belt travel path of the conveyor belt and the aforementioned sensors are connected. The microprocessor, together with a memory, forms a belt counter that is updated on the basis of the signals supplied by the encoder. The microprocessor is programmed to identify a letter jam, a valid letter format or an error on the basis of preparation sensor and print sensor interrogations and a determination of the belt travel path, and to exactly undertake the print control in a path-controlled manner.

9 Claims, 2 Drawing Sheets

POSTAGE METER MACHINE

BACKGROUND OF THE INVENTION

1. Field of the Invention

The present invention is directed to a postage meter machine of the type having a digital printer device with a guide plate and a transport arrangement with a conveyor belt for moving items to be printed past the printer device, and a control unit which generates print control signals for a printhead of the printer device, and having a letter sensor disposed in the guide plate preceding the printhead in the transport direction which supplies a sensor signal to the control unit to ready the printer device for printing.

2. Description of the Prior Art

Postage meter machines can be especially efficiently utilized for franking mail beginning with a moderate to high volume of letters or other postal matter to be mailed. Differing from other printers, a postage meter machine is suitable for processing filled envelopes, possibly also with very different formats. The terms letter, piece of mail or print medium as used herein include all types of envelopes or other print-receiving media. Postal matter, file cards, labels or self-adhesive paper tapes or similar material can be employed as the print medium.

Modern postage meter machines utilize fully electronic digital printer devices. For example, the postage meter machine T1000 of Francotype-Postalia AG & Co. employs a thermal printing unit. With this, it is possible to print arbitrary texts and special characters in the franking stamp printing region. A thermal transfer postage meter machine disclosed in U.S. Pat. No. 4,746,234 has a microprocessor and is surrounded by a secured housing that exhibits an opening for the delivery of a letter, thus the position and movement of the letter can only be indirectly determined. A mechanical letter sensor (micro-switch) communicates a print request signal to the microprocessor as an indication of the position of the letter during transport thereof through the machine. The necessity of precise timing as articles are transported at high speed through the machine results in a high outlay for adjusting triggering of the micro-switch, which is disadvantageous. The microprocessor controls the drive motors and an thermal transfer printing head based on the sensor output. An encoder communicates a signal derived from the transport of the thermal transfer inking ribbon (which moves in a path around a series of rollers) to the microprocessor as further information about the letter transport movement.

European Application 189 268 discloses a receptacle means for inking ribbon cassettes. The sidewall of the cassette has an opening through which a roller projects for seating the inking ribbon in order to receive the drive force therefrom, or to transmit the drive force to a friction roller that is coupled to an encoder disk. The inking ribbon speed approximately corresponds to that of the printed matter that is transported between the inking ribbon and the counter-pressure roller. Given slippage resulting in a lack of synchronization between the letter transport components and the thermal transfer inking ribbon transport components, the derived signal is no longer correct, which correspondingly influences the appearance of the print format.

U.S. Pat. No. 5,495,103 discloses an arrangement for printing on a piece of mail triggered in a time spacing with a time control. Printing is started with a reflected light barrier and with a timer, so that the print format can be exactly positioned on the piece of mail by the user. There is always the possibility, however, that a letter jam will arise given high letter transport speeds. The point of the print triggering shifts when the letter is moved faster. The stamp imprint thus no longer fits completely on the mailing. The required adjustment (made by setting potentiometer) that the user is supposed to undertake according to the printing speed is disadvantageous. The user must undertake an undefined number of trials for adjustment, and it is uncertain what setting of the potentiometers is most likely of success.

German PS 196 05 014 discloses an embodiment of a printer device (JetMail®) that, given a non-horizontal, approximately vertical letter transport, implements a franking print with an ink jet printhead arranged stationary in a recess behind a guide plate. A print sensor for recognizing the start of a letter is arranged before the recess for the ink jet printhead and collaborates with an incremental sensor. By means of pressure elements arranged on the conveyor belt, the letter transport is slip-free and the sensor signal derived during the transport is correct, which has a positive influence on the quality of the print format. Given thick letters, however, the letter's leading edge is not always squared, but can be more or less rounded, so that the start of the letter is not exactly detected.

SUMMARY OF THE INVENTION

An object of the invention is to provide a print control arrangement for a postage meter machine that avoids problems that particularly result from high printing speeds given high printing volume of different types of mail (mixed mail). The control arrangement should be able to recognize a letter jam in time, and to take steps to avoid such a jam insofar as possible, given mixed mail as well. The control arrangement should allow adjustment of the stamp offset independently of the printing speed and without adjustment outlay.

The above objects are achieved in a postage meter machine equipped with a transport path control and with means for preventing a paper jam. The control arrangement of the postage meter machine includes a microprocessor to which an encoder and a print sensor are connected, the latter being arranged in a guide plate lying upstream (in the letter transport direction) directly in front of the printhead. The print sensor supplies signal for the start of printing and serves for recognizing the start of a letter. As a result of the connected encoder, the letter speed in the transport direction is taken into consideration in the calculation, so that the distance or path that the letter traversed can be exactly determined. The start of printing is always exactly detected by the print sensor, which can be fashioned as a transmitted light barrier. No adjustment outlay whatsoever is required due to the exact path measurement. An arbitrary stamp offset thus can also be exactly realized in conjunction with the exact path measurement.

Also in accordance with the invention, a preparation sensor is arranged in the guide plate spaced from the print sensor and upstream therefrom, so that the two sensors are spaced from one another in a predetermined way in the transport direction, and a first belt travel path is determined by a defined letter. The preparation sensor is thus farther from the printhead than the print sensor. A supplied letter passes through its position first. The microprocessor, consequently, is supplied with a first signal by the preparation sensor before it is supplied with the second signal for the start of printing. The length of a respectively supplied letter thus can also be calculated from the sensor signals, this being subsequently checked to determine whether it is in a predetermined, valid size range. Inventively, a paper jam in the above-described postage meter machine can be identified by the microprocessor if that a letter covers at least one of the above sensors for a predetermined belt travel path of the conveyor belt. Together with a memory, the microprocessor forms a belt counter that is updated on the basis of the signals supplied by the encoder, so that an exact path measurement of the belt travel path is enabled. On the basis of the preparation and print sensor interrogations and the determination of the belt travel path, the microprocessor is programmed to identify a paper jam, a valid letter format or an error and to undertake the print control in a precise, path-controlled manner.

DESCRIPTION OF THE PREFERRED EMBODIMENTS

Figure 1:
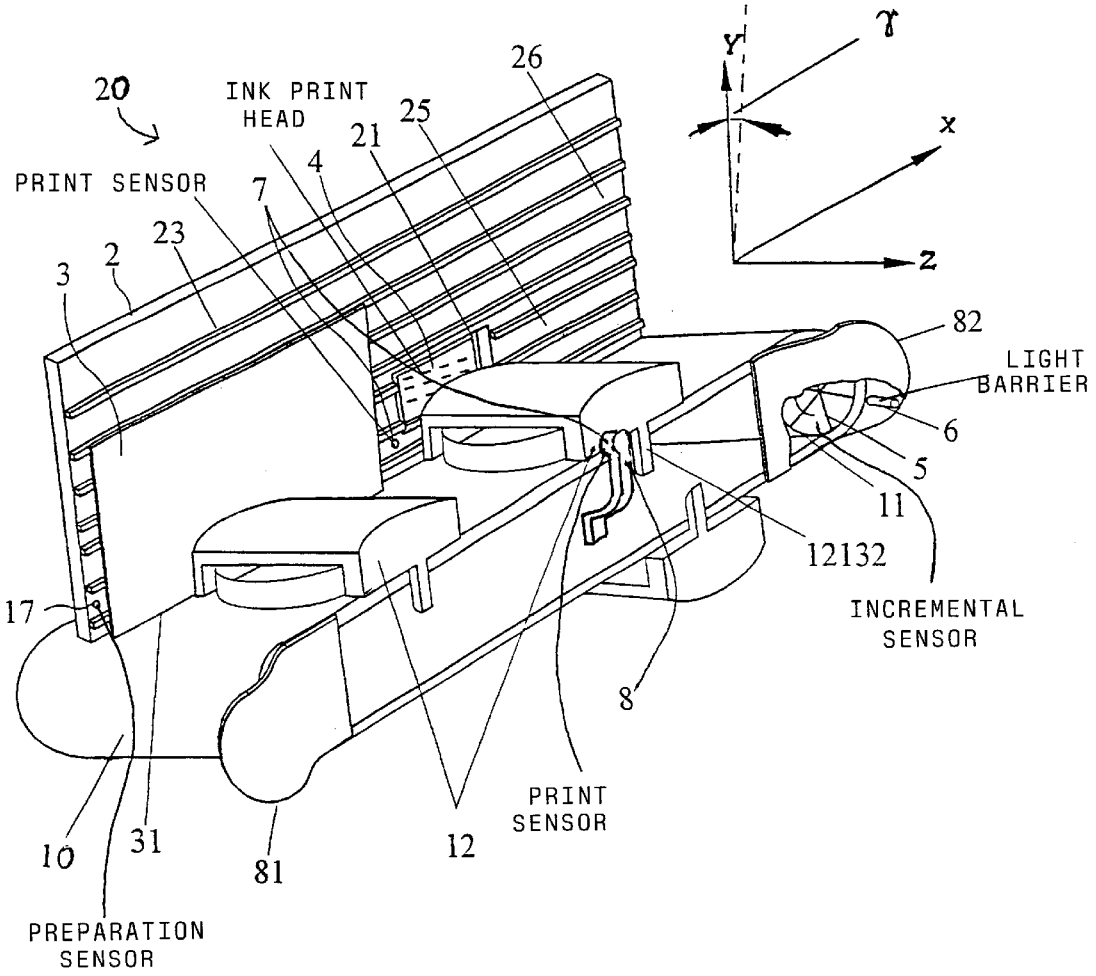
FIG. 1 is a perspective view of the inventive printer device.

FIG. 1 shows the inventive printer device for printing an envelope 3 standing on an edge 31. The device has a conveyor belt 10, arranged orthogonally to the transport plane (XZ-plane) and a guide plate 2 arranged above this in the XY-plane, as well as an ink printhead 4. The envelope is turned over and rotated such that it has its surface lying against the guide rails 23 of the guide plate 2. The guide plate 2 is preferably inclined at an angle y=18° to the perpendicular. The guide plate 2 and conveyor belt 10 describe an angle of 90° with one another. The envelope 3 standing on the conveyor belt 10 necessarily lies against the guide plate 2 due to the slanting attitude thereof and is also pressed by pressure elements 12 that are secured on the conveyor belt 10. Given movement of the conveyor belt 10, a series of letters 3, entrained by the pressure elements 12, slide along the guide rails 23 of the stationary guide plate 2. A continuation 12132 of each pressure element 12 slides on a connecting member with the deflectors 81 and 82 that enables pressing or release of a letter 3 envelope before and after printing, respectively. A recess 21 for the ink printhead 4 is provided in the guide plate 2. In the region behind the recess 21, the guide plate 2 is set back downstream in the transport direction, relative to the seating surface for the letter 3, so that the printed surface is sure to lie free. Sensors 17 and 7 arranged in the guide plate 2 serve respectively for preparation and recognition of the start of the letter and print triggering in the transport direction. The transport mechanism is composed of the conveyor belt 10 and two drums 11. One of the drums 11 is the drive drum equipped with a motor 15 (not visible). In a way not shown, both drums 11 are preferably toothed drums, and the conveyor belt is a toothed belt mating with the drums 11, which assures positive force transmission. An encoder formed by elements 5 and 6 is coupled to the drive drum 11. The drive drum 11 together with an incremental 5 are preferably firmly seated on a shaft (not visible). The incremental sensor 5 is implemented, for example, as a slotted disk that interacts with a light barrier 6.

Figure 2:
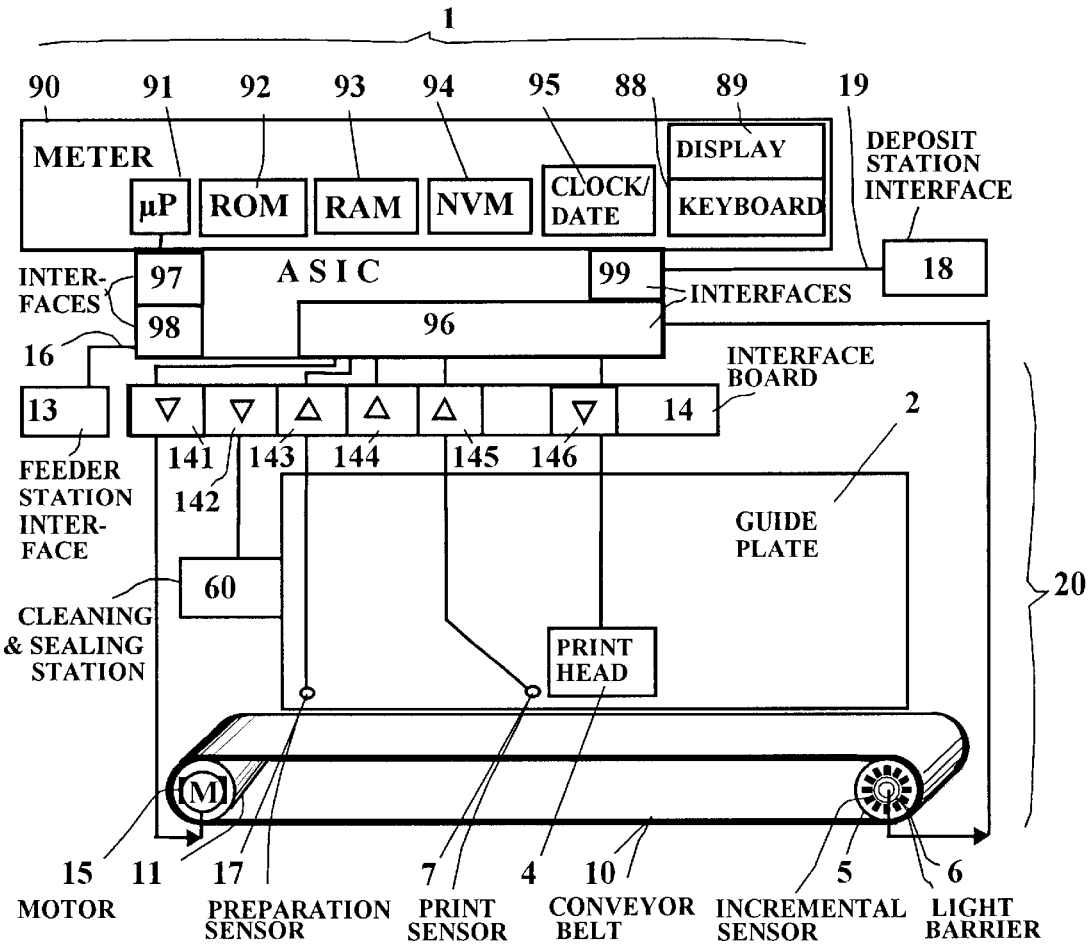
FIG. 2 is block diagram for the drive circuitry of the printer device of FIG. 1.

FIG. 2 shows a block circuit diagram relating to the drive of the printer device 20 with a control unit 1. The control unit 1 includes a microprocessor 91 and known memories 92, 93, 94, a clock/date module 95, a keyboard 88 and a display unit 89 as well as an application-specific circuit ASIC that includes an interface circuit 97 and communicates with the microprocessor 91. The ASIC of the control unit 1 also contains an interface circuit 96 which communicates with the interface board 14 located in the machine base and sets up at least one connection to the light barrier 6, sensors 7, 17 and to the actuators, for example to the drive motor 15 for the drum 11 and to a cleaning and sealing station 60 for the ink jet printhead 4 as well as to the ink jet printhead 4 itself. The basic arrangement and the interaction between the ink jet printhead 4 and the cleaning and sealing station 60 are described in German Application 197 26 642.8.

The print sensor 7 is inventively fashioned as a transmitted light barrier. For example, a light-emitting diode (forming the transmitter of the transmitted light barrier of the print sensor 7) can be arranged in the guide plate 2 and a photodiode (forming the receiver of the transmitted light barrier 7) can be arranged at a distance therefrom corresponding to the maximum thickness (in the Z-direction) of the mailings (letters 3). For example, the photodiode can be secured to a carrier plate 8 at the connecting link between 81 and 82. A reversed arrangement with the photodiode in the guide plate 2 and light-emitting diode at the carrier plate 8 would be just as effective. The start of the letter 3 (leading edge) is thus always exactly detected in the same way given thin and given thick letters. The print sensor 7 supplies the start signal for the path control between this sensor 7 and the first nozzle of the ink jet printhead 4. The print control ensues on the basis of the path control, whereby the selected stamp offset, that is entered via the keyboard 88 and is non-volatilely stored in the memory NVM 94, is taken into consideration. A predetermined imprint thus derives from the stamp offset (without printing), the franking image format, and possibly, further print formats for an advertising slogan, shipping information (selective prints) and additional messages that can be edited.

The individual print elements of the printhead 4 are connected within the housing to printhead electronics so that the printhead can be driven for purely electronic printing, The encoder 5, 6 supplies one signal to the microprocessor 91 per n printing columns. This occurs by means of an interrupt function. A belt counter that stores the motion progress of the motor 15, and thus of the conveyor belt 10, is also updated at every interrupt. Every printing column is preferably 132 $\mu$m wide. The belt counter is a two byte counter, i.e. $2^{16}-1$ counter readings are possible. A maximum letter travel path of $W_{max}=65535\cdot 132\ \mu m\cdot n$ thus can be covered.

A letter evaluation routine is initiated by the preparation sensor 17. To this end, the microprocessor 91 establishes registers in the memory 94 into which are written the belt counter value per letter when the leading edge of the letter is reached, and when the trailing edge of the letter is reached, as variables. The microprocessor 91 determines the letter length L=stop $value_{17}$−start $value_{17}$ from the difference between the two values (start $value_{17}$ for the leading letter edge, stop $value_{17}$ for the trailing letter edge). The microprocessor 91 can then determine the format when the letter length corresponds to a belt travel path that is predetermined for a valid format. The preparation sensor 17 is preferably fashioned as a reflected light barrier because the formats for letters deviate in size to such an extent that a large tolerance must be allowed in the recognition of the letter edges.

An error message is generated when the letter length L is shorter than the intended imprint. A malfunction without the presence of a letter 3 is assumed given a difference of the two values shorter than a predetermined length, i.e. given $L<L_{min}$. No error message ensues. The letter evaluation is ended with the reception of the signal from the print sensor 7. The microprocessor 91 is programmed to recognize and accept a letter as such when the identified letter length L reaches or exceeds a minimum value $L_{min}$ ($L \geqq L_{min}$), and the identified difference of the variable values (print sensor_letter start $value_7$ minus preparation sensor_letter start $value_{17}$, is equal the travel path W) does not exceed a first defined belt travel path $W_{def1}$ ($W \leqq W_{def1}$) corresponding to the distance of the two sensors 7 and 17 from one another (including a certain +/− tolerance value).

Given slip-free transport of a letter 3 or a comparable mailing, the travel path W of the conveyor belt 10 is equal to the defined, first belt travel path, for example $W_{def1}$=100 mm. Given a low-slip transport of a letter, the belt travel path $W_{def1}$ is defined as sum of a tolerance value and the sensor spacing of the two sensors 7 and 17 in the transport direction. The preparation sensor 17 detects the leading letter edge, this being registered by the microprocessor 91 in order to start the belt counter, which sums the encoder pulses until the leading letter edge reaches the print sensor 7. The summed number of pulses is compared to the number of pulses corresponding to the distance between the preparation sensor 17 and the print sensor 7. The allowable deviation for the first defined belt travel path $W_{def1}$ amounts to 10%. A high-slip transport of a letter can potentially causes a jam and leads to a transgression of the defined first belt travel path $W_{def1}$.

Both sensors 17 and 7 are used during the further course of the routine executed by the microprocessor 91 in order to recognize a letter jam. The print sensor 7 detects the leading letter edge, this being registered by the microprocessor 91. A letter jam in the above-described postage meter machine becomes identifiable for the microprocessor 91 if a letter 3 covers at least one of the two sensors 17 and 7 for a second predetermined belt travel path $W_{def2}$, preferably $W_{def2}$>400 mm (approximately). When the difference print sensor_letter start $value_7$ minus preparation sensor_letter start $value_{17}$ becomes greater than 400 mm, this can no longer be caused by a large letter format but can only be interpreted as a malfunction. The microprocessor 91 determines the letter length from the difference of the two values corresponding to the trailing letter edge and leading letter edge detected by one of the sensors 7 or 17, with an error message being generated when the letter length is longer than the predetermined belt travel path. In particular, the microprocessor 91 determines the letter length L from the difference of the two values supplied by the belt counter: start $value_{17}$ for the leading letter edge detected by the sensor 17, and stop $value_{17}$ for the trailing letter edge detected by the sensor 17 (with L=stop $value_{17}$−start $value_{17}$). The format thus can be determined with one of the sensors, with the identified letter length corresponding to a belt travel path that is predetermined for a valid format, or lies in one of the ranges defined for formats.

The print control and sensor interrogations are thus all path-controlled. Further sensors for the differentiated determination of a valid letter format and/or for path control of the postage meter machine or another type of franking system can be arranged next to or between the sensors 7 and 17.

FIG. 2 also shows a further interface circuit 99 that is connected via a data cable toward the right to an interface circuit 18 of a deposit station following downstream, and allows the control thereof by the control unit 1. Another peripheral device to the left of the postage meter machine base is preferably an automatic feeder station and has its interface circuit 13 connected via a cable 16 to an interface circuit 98 of the ASIC.

Further sensors can be arranged in the aforementioned further stations for detecting the letter edges, these being coupled via the aforementioned interfaces to the microprocessor 91 in the control unit 1 in order to enable or monitor the system operation.

An embodiment for a number of peripheral devices (stations) suitable for the peripheral interface is described in German Application 197 11 997.2, corresponding to co-pending U.S. application Ser. No. 09/041,469 filed Mar. 12, 1998 and assigned to the same assignee as the present application.

The printer device can also be realized differently from the embodiment described herein.

Although modifications and changes may be suggested by those skilled in the art, it is the intention of the inventor to embody within the patent warranted hereon all changes and modifications as reasonably and properly come within the scope of his contribution to the art.

I claim as my invention:

1. A postage meter machine comprising:

a digital printer device including a printhead;

a guide plate;

transport means including a conveyor belt for moving items along said guide plate in a transport direction toward said digital printer device, said items comprising items to be printed by said digital printer device;

a print sensor disposed in said guide plate preceding said print head which emits a print sensor signal when an item on said guide plate is disposed adjacent said print sensor;

a preparation sensor disposed in said guide plate at a predetermined distance upstream from said print sensor in said transport direction, said preparation sensor emitting a preparation sensor signal when an item on said guide plate is adjacent said preparation sensor;

encoder means for emitting an encoder signal dependent on movement of said conveyor belt in said transport direction; and control means supplied with said print sensor signal, said preparation sensor signal and said encoder signal, and connected to said digital printer device, for, from said print sensor signal, said preparation sensor signal and said encoder signal, initiating printing by said digital printer device on one of said items controlled precisely by a distance traversed by the item to be printed along said guide plate, for identifying occurrence of an item jam along said guide plate, and for identifying a valid item format, said control unit including a memory to which at least said encoder signal is supplied and forming a belt counter which is updated by said encoder signal to identify a belt travel distance traversed by said conveyor belt in said transport direction.

2. A postage meter machine as claimed in claim 1 wherein said print sensor comprises a light transmitter which is occluded as one of said items passes by said print sensor.

3. A postage meter machine as claimed in claim 1 wherein said preparation sensor comprises a light transmitter which is occluded as one of said items passes by said preparation sensor.

4. A postage meter machine as claimed in claim I wherein said control means comprises means for identifying said occurrence of an item jam if at least one of said print sensor signal and said preparation sensor signal identifies an item adjacent to at least one of the print sensor or the preparation sensor for a predetermined length of travel of said belt.

5. A postage meter machine as claimed in claim 4 wherein said control means comprises means for determining an item length from a difference between a trailing edge of an item and a leading edge of the same item identified by at least one of said print sensor or said preparation sensor and for generating an error message if an item has an item length which is longer than said predetermined length of travel of said belt.

6. A postage meter machine as claimed in claim 1 wherein said control means comprises means for identifying an item length from values respectively corresponding to a trailing edge of an item and a leading edge of the same item detected by at least one of said print sensor or said preparation sensor, and for generating an error message if an item has an item length which is shorter than an imprint to be produced by said digital printer device.

7. A postage meter machine as claimed in claim 1 further comprising at least one additional sensor which supplies an additional sensor signal to said control means for detecting an edge of an item on said guide path.

8. A postage meter machine as claimed in claim 1 wherein said control means comprises means for identifying a leading edge of an item upon receipt of said preparation sensor signal and thereupon starts said belt counter, said memory comprising said belt counter accumulating pulses in said encoder signal until said leading edge reaches said print sensor along said guide plate, and said control means comprising means for counting an accumulated number of encoder pulses to a predetermined number of pulses representing a distance between said preparation sensor and said print sensor along said guide plate.

9. A postage meter machine as claimed in claim 8 wherein said control means comprises means for identifying an item length from a difference between a value of said belt counter at said leading edge of said item detected by said preparation sensor and a value supplied by said belt counter at detection of a trailing edge of the same item by said preparation sensor.

* * * * *